US009970671B2

(12) United States Patent
Bailey et al.

(10) Patent No.: US 9,970,671 B2
(45) Date of Patent: May 15, 2018

(54) BULKHEAD ASSEMBLIES AND METHODS FOR AIR CONDITIONER UNITS

(71) Applicant: General Electric Company, Schenectady, NY (US)

(72) Inventors: Thomas Allen Bailey, Louisville, KY (US); Brice Alan Bowley, Goshen, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 225 days.

(21) Appl. No.: 14/722,687

(22) Filed: May 27, 2015

(65) Prior Publication Data

US 2016/0348934 A1 Dec. 1, 2016

(51) Int. Cl.

| | |
|---|---|
| ***F25D 17/04*** | (2006.01) |
| ***F24F 11/00*** | (2018.01) |
| ***F24F 13/30*** | (2006.01) |
| ***F24F 13/28*** | (2006.01) |
| ***F24F 13/14*** | (2006.01) |
| ***F24F 1/02*** | (2011.01) |
| ***F24F 11/053*** | (2006.01) |

(52) U.S. Cl.

CPC ..... *F24F 11/0012* (2013.01); *F24F 1/022* (2013.01); *F24F 11/0015* (2013.01); *F24F 11/0076* (2013.01); *F24F 11/053* (2013.01); *F24F 13/1426* (2013.01); *F24F 13/28* (2013.01); *F24F 13/30* (2013.01); *F24F 2011/0013* (2013.01); *F24F 2011/0016* (2013.01); *F24F 2013/1446* (2013.01)

(58) Field of Classification Search

CPC .... F24F 11/0012; F24F 11/00; F24F 11/0015; F24F 11/053; F24F 1/022; F24F 13/1426; F24F 13/28; F24F 13/30; F24F 2011/0013; F24F 2011/0016

See application file for complete search history.

(56) References Cited

U.S. PATENT DOCUMENTS

| | | | | |
|---|---|---|---|---|
| 5,392,613 | A * | 2/1995 | Bolton | F24F 1/027 62/262 |
| 6,497,740 | B1 | 12/2002 | Moretti | |
| 8,266,916 | B2 | 9/2012 | Dillon | |
| 2005/0056037 | A1 * | 3/2005 | Park | F24F 1/0011 62/262 |

(Continued)

*Primary Examiner* — Len Tran
*Assistant Examiner* — Kamran Tavakoldavani
(74) *Attorney, Agent, or Firm* — Dority & Manning, P.A.

(57) ABSTRACT

Air conditioner units, bulkhead assemblies, and methods for operating air conditioner units are provided. A bulkhead assembly includes a bulkhead which includes a first sidewall, a second sidewall, and a rear wall extending laterally between the first sidewall and the second sidewall. The rear wall includes an indoor facing surface and an opposing outdoor facing surface. The bulkhead assembly further includes a vent aperture defined in the rear wall, and a vent door movable between an open position and a closed position, wherein in the open position the vent door permits air flow through the vent aperture and in the closed position the vent door inhibits air flow through the vent aperture. The bulkhead assembly further includes a drive assembly connected to the vent door and operable to selectively move the vent door between the open position and the closed position.

9 Claims, 8 Drawing Sheets

(56) References Cited

U.S. PATENT DOCUMENTS

| | | | | |
|---|---|---|---|---|
| 2011/0303755 | A1* | 12/2011 | Ariga | F24F 1/02<br>237/2 A |
| 2012/0042672 | A1* | 2/2012 | Fujihara | F24F 3/14<br>62/157 |
| 2015/0219356 | A1* | 8/2015 | Ito | G05D 23/1904<br>165/237 |

* cited by examiner

BULKHEAD ASSEMBLIES AND METHODS FOR AIR CONDITIONER UNITS

FIELD OF THE INVENTION

The present disclosure relates generally to air conditioner units and methods for operating air conditioner units, and more particularly to improved apparatus for operating vents associated with bulkheads of air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. A typical such air conditioner unit includes an indoor portion and an outdoor portion. The indoor portion is generally located indoors, and the outdoor portion is generally located outdoors. Accordingly, the air conditioner unit generally extends through a wall, window, etc. of the structure.

In the outdoor portion of a conventional air conditioner unit, a compressor that operates a refrigerating cycle is provided. At the back of the outdoor portion, an outdoor heat exchanger connected to the compressor is disposed, and facing the outdoor heat exchanger, an outdoor fan for cooling the outdoor heat exchanger is provided. At the front of the indoor portion of a conventional air conditioner unit, an air inlet is provided, and above the air inlet, an air outlet is provided. A blower fan and a heating unit are additionally provided in the indoor portion. Between the blower fan and heating unit and the air inlet, an indoor heat exchanger connected to the compressor is provided.

When cooling operation starts, the compressor is driven to operate the refrigerating cycle, with the indoor heat exchanger serving as a cold-side evaporator of the refrigerating cycle, and the outdoor heat exchanger as a hot-side condenser. The outdoor heat exchanger is cooled by the outdoor fan to dissipate heat. As the blower fan is driven, the air inside the room flows through the air inlet into the air passage, and the air has its temperature lowered by heat exchange with the indoor heat exchanger, and is then blown into the room through the air outlet. In this way, the room is cooled.

When heating operation starts, the heating unit is operated to raise the temperature of air in the air passage. The air, having had its temperature raised, is blown out through the air outlet into the room to heat the room.

Further, conventional air conditioner units include a bulkhead which is positioned between the indoor portion and outdoor portion, and thus generally separates the components within the indoor portion from the components in the outdoor portion. Various components may additionally be connected to the bulkhead, such as the blower fan and heating unit.

In some cases, it may be desirable to allow outdoor air through the bulkhead into a room into which the air conditioner unit extends. Accordingly, many bulkheads include vent apertures for allowing such airflow. A filter may be positioned in alignment with a vent aperture of a bulkhead to filter the air flowing through the vent aperture. Further, a cover may be provided on the vent aperture. Manual removal of such cover may uncover the vent aperture and allow air flow therethrough, while manual replacement may restrict such air flow. It may be desirable, for example, to remove the cover when certain environmental conditions, i.e. certain temperatures or humidity levels, exist outdoors relative to indoor conditions, and to replace the cover when certain other environmental conditions exist outdoors relative to indoor conditions. Use of the vent aperture may provide energy efficiency under particular environmental conditions.

One issue with many known bulkheads and air conditioner units is the difficulty in accessing the vent aperture to, for example, manually remove and/or replace such covers. For example, in many cases, accessing a vent aperture may require that the internal components of the air conditioner unit are removed from the housing of the air conditioner unit, and particularly from the wall sleeve of the housing. Further disassembly of various of the internal components may additionally be required. Accordingly, the manually remove and/or replace such covers is a time-consuming and labor intensive procedure.

Accordingly, improved apparatus for opening and closing vent apertures associated with bulkheads in air conditioner units is desired in the art. In particular, apparatus which facilitate automated vent aperture opening and closing without requiring disassembly of the associated air conditioner unit would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, an air conditioner unit is provided. The air conditioner unit includes an outdoor heat exchanger, an indoor heat exchanger, and a bulkhead disposed between the outdoor heat exchanger and the indoor heat exchanger along a transverse direction. The bulkhead includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The air conditioner unit further includes a vent aperture defined in the rear wall. The air conditioner unit further includes a vent door movable between an open position and a closed position, wherein in the open position the vent door permits air flow through the vent aperture and in the closed position the vent door inhibits air flow through the vent aperture. The air conditioner unit further includes a drive assembly connected to the vent door and operable to selectively move the vent door between the open position and the closed position. The air conditioner unit further comprises a controller in communication with the drive assembly, the controller operable to actuate the drive assembly and move the vent door between the open position and the closed position.

In accordance with another embodiment, a bulkhead assembly for an air conditioner unit is provided. The bulkhead assembly includes a bulkhead which includes a first sidewall, a second sidewall spaced apart from the first sidewall along a lateral direction, and a rear wall extending laterally between the first sidewall and the second sidewall. The rear wall includes an indoor facing surface and an opposing outdoor facing surface. The bulkhead assembly further includes a vent aperture defined in the rear wall. The bulkhead assembly further includes a vent door movable between an open position and a closed position, wherein in the open position the vent door permits air flow through the vent aperture and in the closed position the vent door inhibits air flow through the vent aperture. The bulkhead assembly further includes a drive assembly connected to the vent door and operable to selectively move the vent door between the open position and the closed position.

In accordance with another embodiment, a method for operating an air conditioner unit is provided. The method includes measuring an indoor environmental condition and an outdoor environmental condition, and determining whether a difference between the outdoor environmental condition and the indoor environmental condition is within a predetermined condition range. The method further includes moving a vent door of a bulkhead assembly into an open position wherein air flow through a vent aperture defined in a bulkhead of the bulkhead assembly is permitted when the difference between the outdoor environmental condition and the indoor environmental condition is within a predetermined condition range. The method further includes moving the vent door into a closed position wherein air flow through the vent aperture is inhibited when the difference between the outdoor environmental condition and the indoor environmental condition is not within the predetermined condition range.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
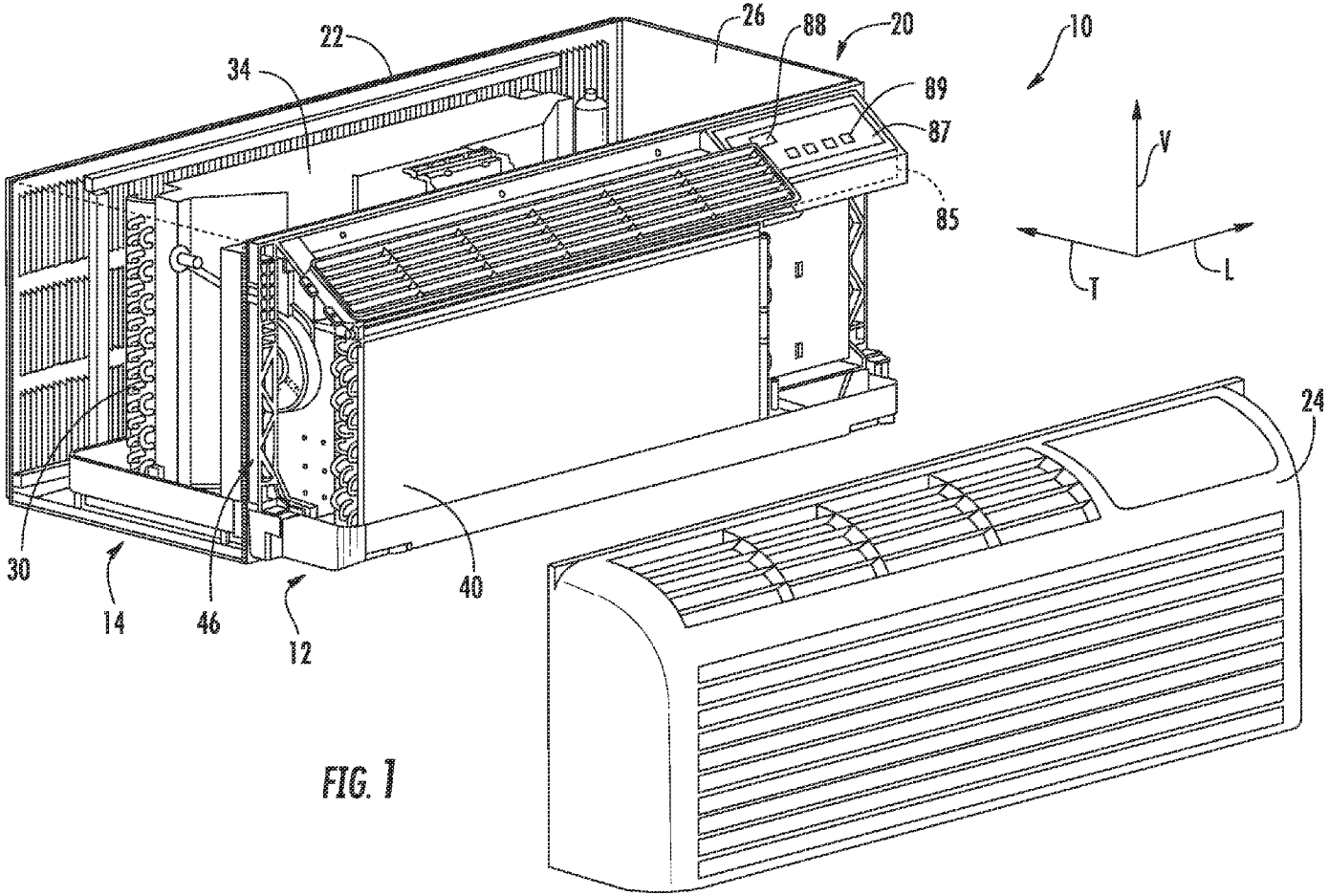
FIG. 1 provides a perspective view of an air conditioner unit, with a room front exploded from a remainder of the air conditioner unit for illustrative purposes, in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an air conditioner unit 10 is provided. The air conditioner unit 10 is a one-unit type air conditioner, also conventionally referred to as a room air conditioner. The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined.

A housing 20 of the unit 10 may contain various other components of the unit 10. Housing 20 may include, for example, a rear grill 22 and a room front 24 which may be spaced apart along the transverse direction by a wall sleeve 26. The rear grill 22 may be part of the outdoor portion 14, which the room front 24 is part of the indoor portion 12. Components of the outdoor portion 14, such as an outdoor heat exchanger 30, outdoor fan (not shown), and compressor (not shown) may be housed within the wall sleeve 26. A casing 34 may additionally enclose the outdoor fan, as shown.

Figure 2:
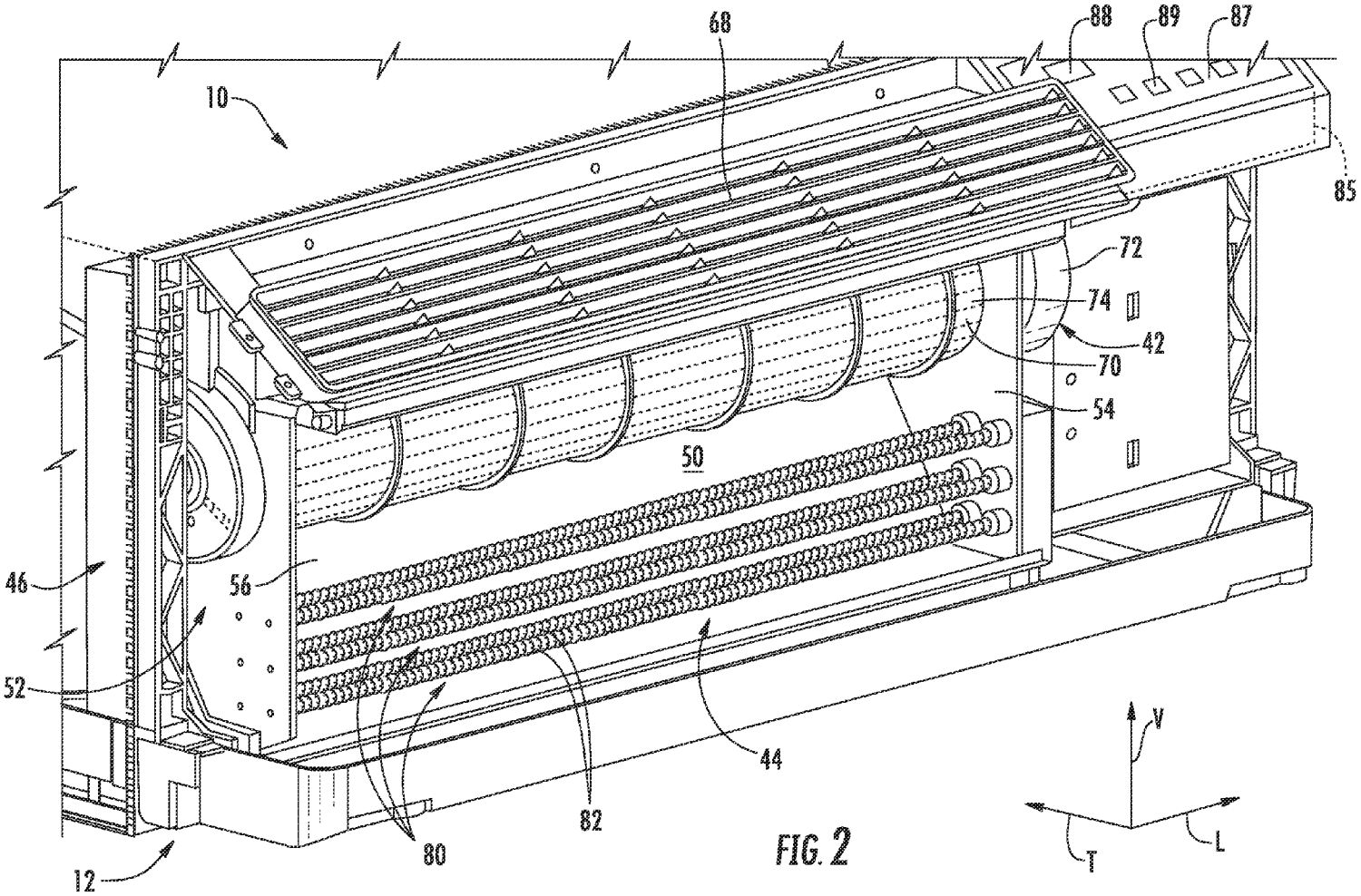
FIG. 2 is a perspective view of components of an indoor portion of an air conditioner unit in accordance with one embodiment of the present disclosure.

Referring now also to FIG. 2, indoor portion 12 may include, for example, an indoor heat exchanger 40, a blower fan 42, and a heating unit 44. These components may, for example, be housed behind the room front 24. Additionally, a bulkhead 46 may generally support and/or house various other components or portions thereof of the indoor portion 12, such as the blower fan 42 and the heating unit 44. Bulkhead 46 may generally separate and define the indoor portion 12 and outdoor portion 14.

Bulkhead 46 may include various peripheral surfaces that define an interior 50 thereof. For example, and additionally referring to FIGS. 3 and 4, bulkhead 46 may include a first sidewall 52 and a second sidewall 54 which are spaced apart from each other along the lateral direction L. A rear wall 56 may extend laterally between the first sidewall 52 and second sidewall 54. The rear wall 56 may, for example, include an upper portion 60 and a lower portion 62. Upper portion 60 may for example have a generally curvilinear cross-sectional shape, and may accommodate a portion of the blower fan 42 when blower fan 42 is housed within the interior 50. Lower portion 62 may have a generally linear cross-sectional shape, and may be positioned below upper portion 60 along the vertical direction V. Rear wall 56 may further include an indoor facing surface 64 and an opposing outdoor facing surface. The indoor facing surface 64 may face the interior 50 and indoor portion 12, and the outdoor facing surface 66 may face the outdoor portion 14.

Bulkhead 46 may additionally extend between a top end 61 and a bottom end 63 along vertical axis V. Upper portion 60 may, for example, include top end 61, while lower portion 62 may, for example, include bottom end 63.

Bulkhead 46 may additionally include, for example, an air diverter 68, which may extend between the sidewalls 52, 54 along the lateral direction L and which may flow air therethrough.

In exemplary embodiments, blower fan 42 may be a tangential fan. Alternatively, however, any suitable fan type may be utilized. Blower fan 42 may include a blade assembly 70 and a motor 72. The blade assembly 70, which may include one or more blades disposed within a fan housing 74, may be disposed at least partially within the interior 50 of the bulkhead 46, such as within the upper portion 60. As shown, blade assembly 70 may for example extend along the lateral direction L between the first sidewall 52 and the second sidewall 54. The motor 72 may be connected to the blade assembly 70, such as through the housing 74 to the blades via a shaft. Operation of the motor 72 may rotate the blades, thus generally operating the blower fan 42. Further, in exemplary embodiments, motor 72 may be disposed exterior to the bulkhead 46. Accordingly, the shaft may for example extend through one of the sidewalls 52, 54 to connect the motor 72 and blade assembly 70.

Heating unit 44 in exemplary embodiments includes one or more heater banks 80. Each heater bank 80 may be operated as desired to produce heat. In some embodiments as shown, three heater banks 80 may be utilized. Alternatively, however, any suitable number of heater banks 80 may be utilized. Each heater bank 80 may further include at least one heater coil or coil pass 82, such as in exemplary embodiments two heater coils or coil passes 82. Alternatively, other suitable heating elements may be utilized.

The operation of air conditioner unit 10 including blower fan 42, heating unit 44, and other suitable components may be controlled by a processing device such as a controller 85. Controller 85 may be in communication (via for example a suitable wired or wireless connection) to such components of the air conditioner unit 10. By way of example, the controller 85 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 87 and one or more user inputs 89, which may be included in control panel 87. The user inputs 89 may be in communication with the controller 85. A user of the unit 10 may interact with the user inputs 89 to operate the unit 10, and user commands may be transmitted between the user inputs 89 and controller 85 to facilitate operation of the unit 10 based on such user commands. A display 88 may additionally be provided in the control panel 87, and may be in communication with the controller 85. Display 88 may, for example be a touchscreen or other text-readable display screen, or alternatively may simply be a light that can be activated and deactivated as required to provide an indication of, for example, an event or setting for the unit.

Referring now to FIGS. 3 through 8, embodiments of a bulkhead assembly 100 which includes a bulkhead 46 are illustrated. As discussed, bulkhead 46 includes a first side surface 52 and second side surface 54, as well as a rear wall 56 extending therebetween. Further, a vent aperture 102 may be defined in the rear wall 56. Vent aperture 102 may allow air flow therethrough between the indoor portion 12 and outdoor portion 14, and may be utilized in an installed air conditioner unit 10 to allow outdoor air to flow therethrough into the indoor portion 12.

Figure 4:
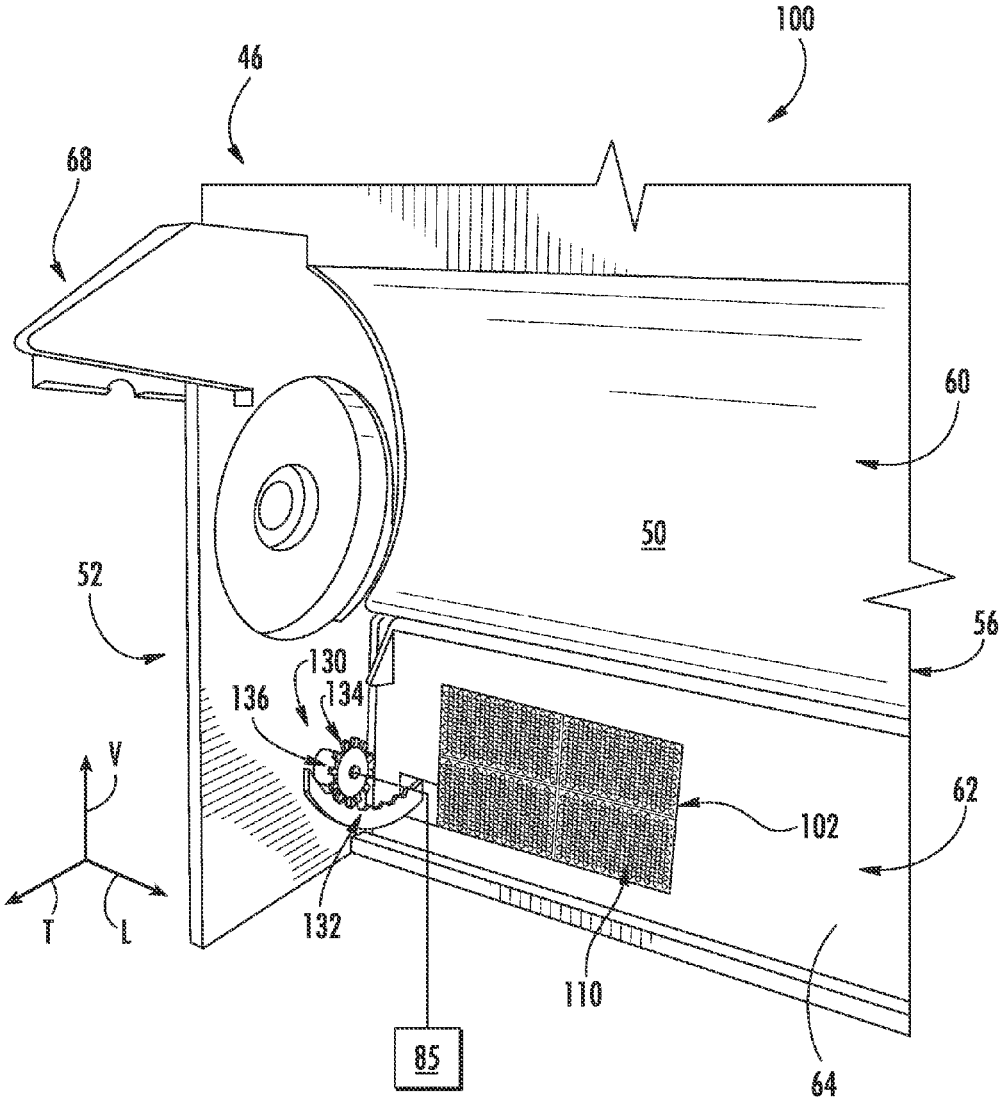
FIG. 4 is a front perspective view of a bulkhead assembly in accordance with one embodiment of the present disclosure.

In some embodiments as shown in FIG. 4, in order to filter the air flowing through vent aperture 102, a filter 110 may be provided. The filter 110 may generally filter air flowing therethrough. Any suitable material(s) may be utilized for filter 110 generally. In some embodiments, for example, filter 110 (or components thereof) may be formed from one or more suitable plastics. For example, filter 110 may include a polypropylene or acrylonitrile butadiene styrene frame and/or a polypropylene filter mesh. The filter 110 may be positionable in alignment with the vent aperture 102, such that when in positioned in such alignment the filter 110 may extend across the vent aperture 102 to provide filtering of the air flow.

Figure 3:
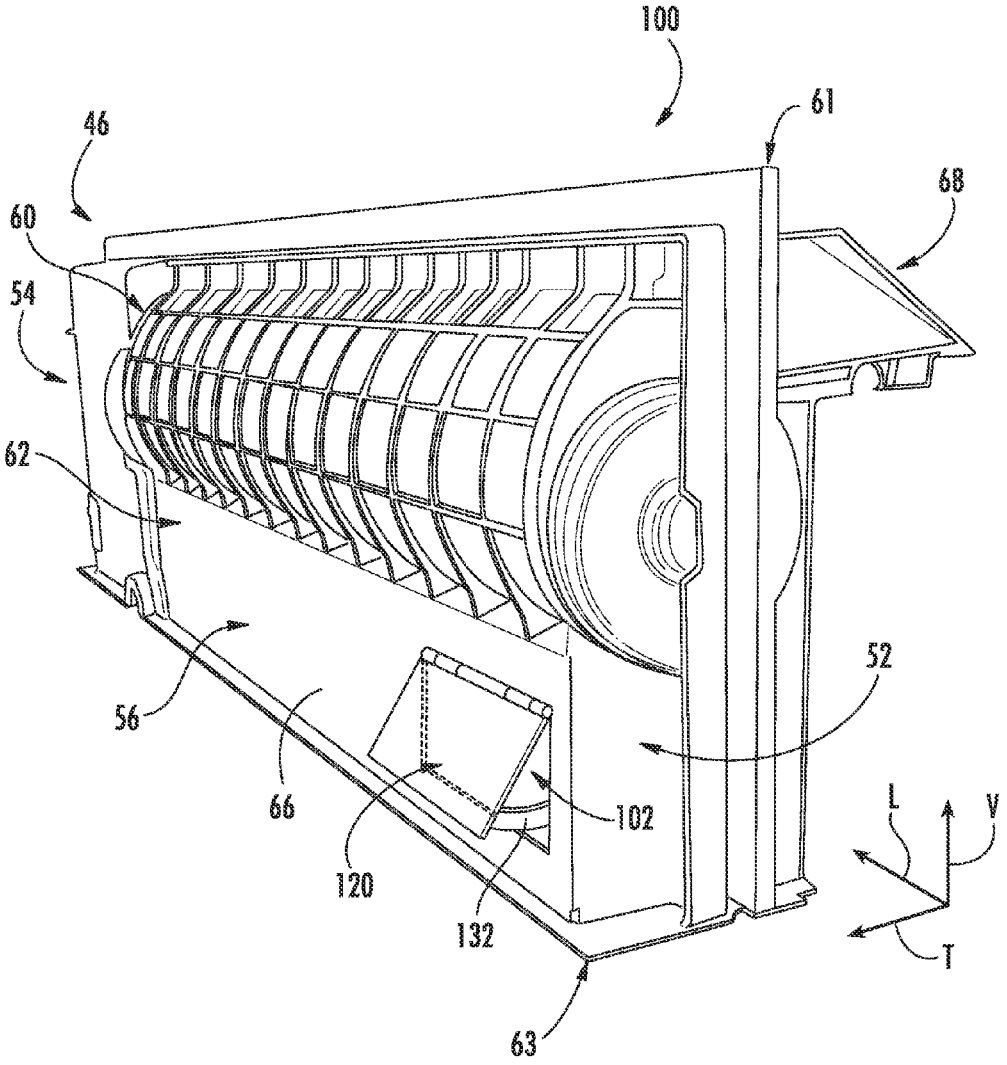
FIG. 3 is a rear perspective view of a bulkhead assembly in accordance with one embodiment of the present disclosure.
Figure 5:
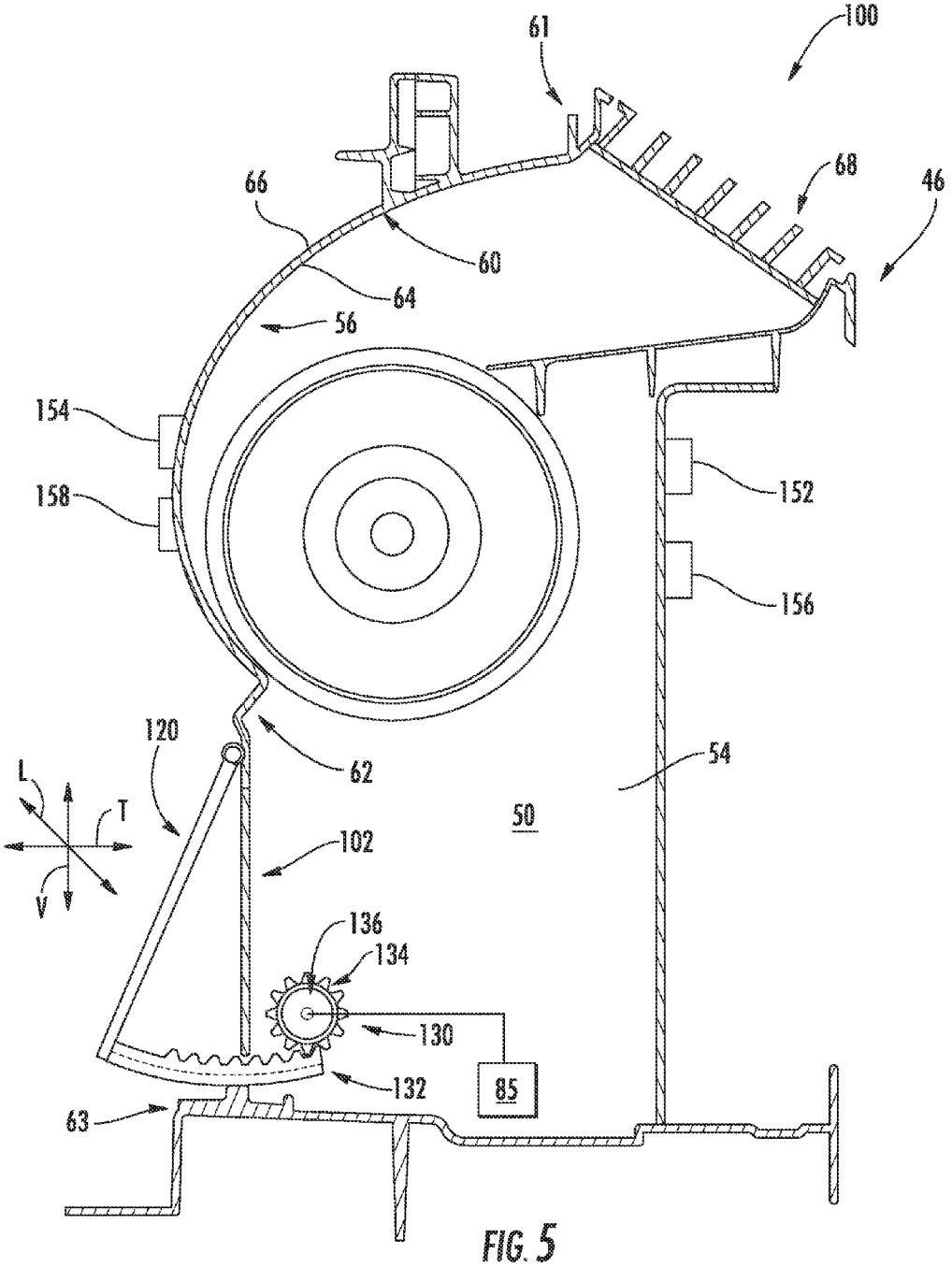
FIG. 5 is a cross-sectional view of a bulkhead assembly with a vent door in an open position in accordance with one embodiment of the present disclosure.
Figure 6:
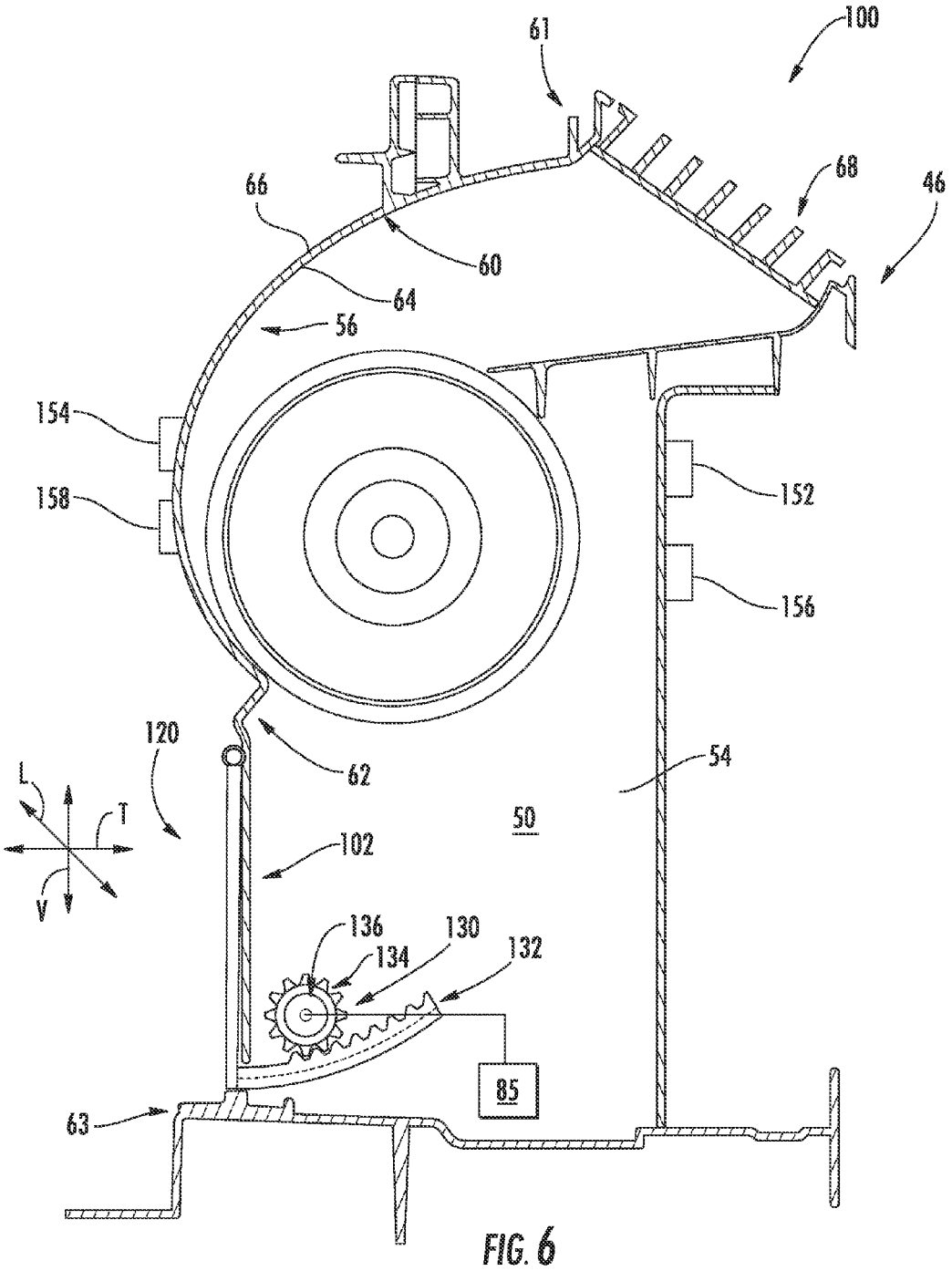
FIG. 6 is a cross-sectional view of a bulkhead assembly with a vent door in a closed position in accordance with one embodiment of the present disclosure.
Figure 7:
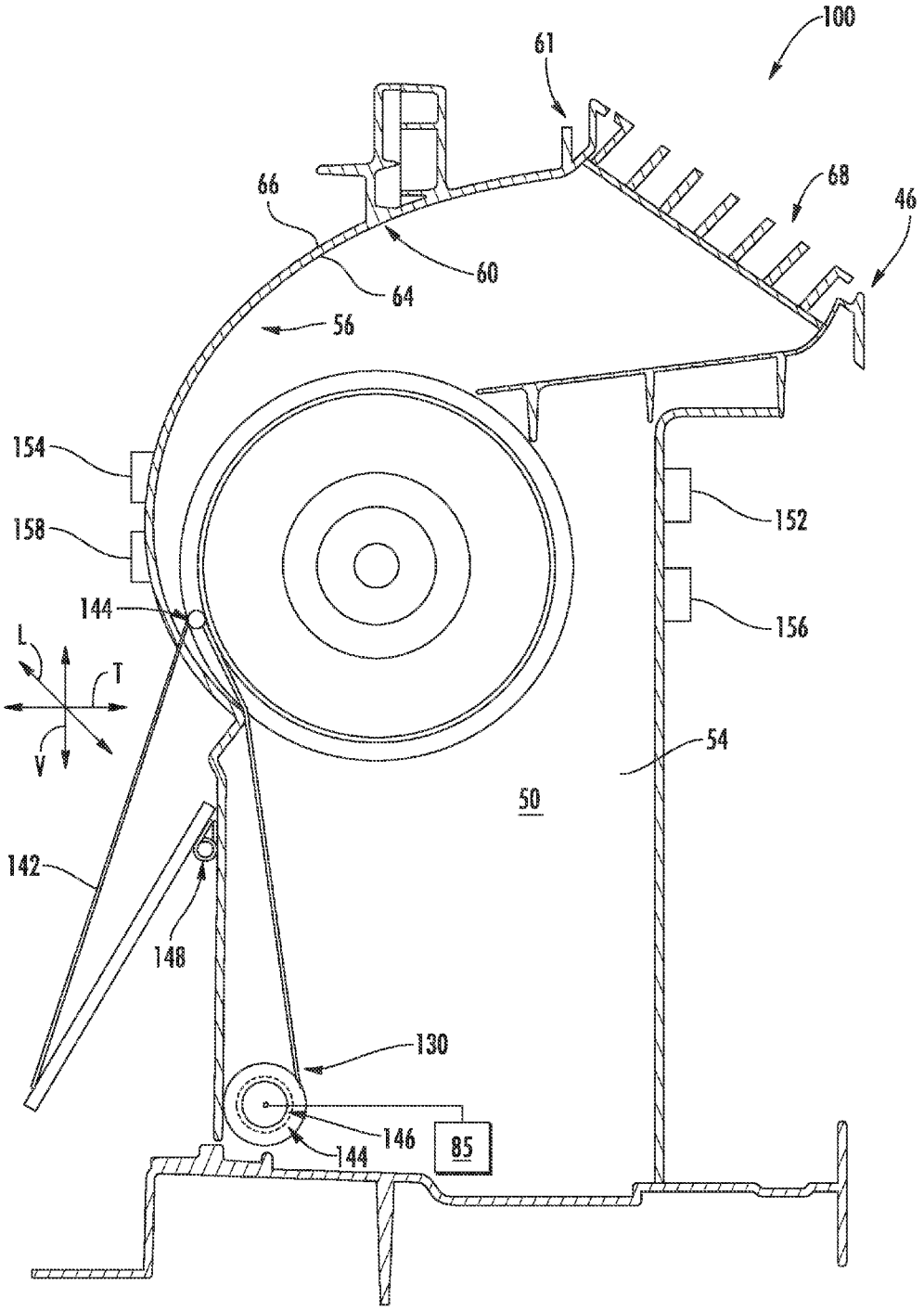
FIG. 7 is a cross-sectional view of a bulkhead assembly with a vent door in an open position in accordance with one embodiment of the present disclosure.
Figure 8:
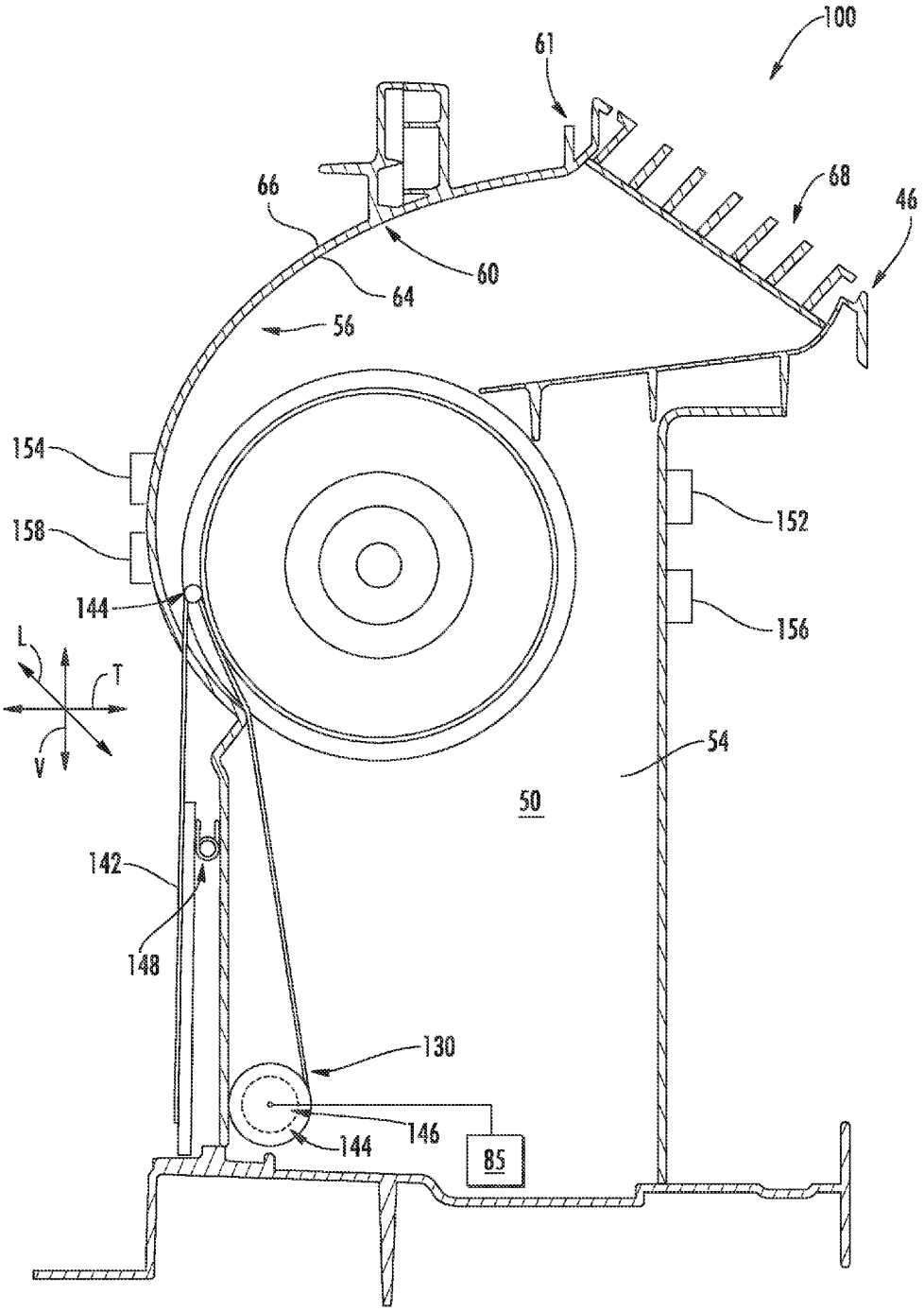
FIG. 8 is a cross-sectional view of a bulkhead assembly with a vent door in a closed position in accordance with one embodiment of the present disclosure

Bulkhead assembly 100 may further include a vent door 120 which may be movable between an open position (as illustrated in FIGS. 3, 5 and 7) and a closed position (as illustrated in FIGS. 6 and 8). For example, in exemplary embodiments, the vent door 120 may be connected at one end to the bulkhead 42, such as to the indoor facing surface 64 or the outdoor facing surface 66 (as shown). The connection may, for example, be a direct connection or an indirect connection via a hinge. The vent door 120 may rotate about this connection between open and closed positions. In the open position, the door 120 may permit air flow through the vent aperture 102, while in the closed position, the door 120 may inhibit air flow through the vent aperture 102.

Further, bulkhead assembly 100 may advantageously include a drive assembly 130. Drive assembly 130 may be connected to vent door 120, and may be operable to selectively move the vent door 120 between the open position and the closed position. For example, in some embodiments, the drive assembly 130 can be actuated to move the vent door 120 to the open position and actuated to move the vent door 120 to the closed position. In other embodiments, the drive assembly 130 can be actuated to move the vent door 120 only to the open position or closed position, with de-actuation of the drive assembly 130 causing movement of the vent door 120 to the other of the open position or closed position.

In some embodiments, as illustrated in FIGS. 3-6, drive assembly 130 may include a rack gear 132, a pinion gear 134 and a motor 136. The rack gear 132 may be connected to the vent door 120, the pinion gear 134 may mesh with the rack gear 132, and the motor 136 may drive the pinion gear 134. Actuation of the motor 136 in a first direction may cause rotation of the pinion gear 134 in the first direction, thus causing movement of the door 120 towards an open position. Actuation of the motor 136 in a second direction may cause rotation of the pinion gear 134 in the second direction, thus causing movement of the door 120 towards a closed position.

In other embodiments, as illustrated in FIGS. 7 and 8, drive assembly 130 may include a cable 142, one or more pulleys 144, and a motor 146. Further, in some embodiments, drive assembly 130 may additionally include a biasing element 148, such as a spring. The cable 142 may be connected at one end to the vent door 120, may further be connected at the other end to the motor 146 or a pulley 144. Actuation of the motor 146 in a first direction may cause movement of the cable 142 which may move the door 120 towards an open position. De-actuation of the motor 146 may cause the door 120 to move towards a closed position, either due to the weight and orientation of the door itself or due to a biasing force of the biasing element 148.

In other embodiments, drive assembly 130 may include a solenoid valve and linkage assembly, a pneumatic or hydraulic cylinder, a motor and linkage assembly, a biasing element connected to a motor, another suitable gear assembly, etc. Further it should be understood that the present disclosure is not limited to the above described drive assemblies 130, and rather that any suitable assembly configured to automatically move vent door 120 between open and closed positions is within the scope and spirit of the present disclosure.

As discussed, air conditioner unit 10 (and bulkhead assembly 100) may include a controller 85. In exemplary embodiments, controller 85 may be in communication with the drive assembly 130. Controller 85 may be operable to actuate the drive assembly 130 and move the vent door 120 between the open position and the closed position. For example, controller 85 may selectively actuate and de-actuate a motor, such as motor 136, 146, or solenoid or other driving component of the drive assembly 130, in various directions as required, such as in the directions as discussed above.

In further exemplary embodiments, controller may 85 may actuate the drive assembly 130 and move the vent door 120 between the open position and the closed position based on particular environmental conditions. For example, controller 85 may cause movement of the vent door 120 to the open position when particular environmental conditions are met, and may cause movement of the vent door 120 to the closed position when other particular environmental conditions are met.

In some embodiments, for example, air conditioner unit 10 may include a first temperature sensor 152 and a second temperature sensor 154. The first temperature sensor 152 may, for example, be positioned in the indoor portion 12 of the air conditioner unit 10 and/or on an indoor side of the air conditioner unit 10 when installed. The first temperature sensor 152 may thus be configured to measure an indoor temperature, i.e. a surrounding environmental temperature of the indoor side. The second temperature sensor 154 may, for example, be positioned in the outdoor portion 14 of the air conditioner unit 10 and/or on an outdoor side of the air conditioner unit 10 when installed. The second temperature sensor 154 may thus be configured to measure an outdoor temperature, i.e. a surrounding environmental temperature of the outdoor side.

Additionally or alternatively, for example, air conditioner unit 10 may include a first humidity sensor 156 and a second humidity sensor 158. The first humidity sensor 156 may, for example, be positioned in the indoor portion 12 of the air conditioner unit 10 and/or on an indoor side of the air conditioner unit 10 when installed. The first humidity sensor 156 may thus be configured to measure an indoor humidity (i.e. relative humidity, absolute humidity or specific humidity), i.e. a surrounding environmental humidity of the indoor side. The second humidity sensor 158 may, for example, be positioned in the outdoor portion 14 of the air conditioner unit 10 and/or on an outdoor side of the air conditioner unit 10 when installed. The second humidity sensor 158 may thus be configured to measure an outdoor humidity (i.e. relative humidity, absolute humidity or specific humidity), i.e. a surrounding environmental humidity of the outdoor side.

It should be understood that the present disclosure is not limited to the use of temperature sensors and/or humidity sensors, and rather that any suitable sensors for measuring suitable environmental conditions on the indoor and outdoor sides of the air conditioner unit 10 may be utilized.

Controller 85 may, for example, be operable to move the vent door 120 to an open position when a difference between an outdoor environmental condition (i.e. an outdoor temperature or outdoor humidity) and an indoor environmental condition (i.e. an indoor temperature or indoor humidity) is within a predetermined environmental condition (i.e. temperature or humidity) range. Controller 85 may, for example, further be operable to move the vent door 120 to a closed position when a difference between an outdoor environmental condition (i.e. an outdoor temperature or outdoor humidity) and an indoor environmental condition (i.e. an indoor temperature or indoor humidity) is outside of the predetermined environmental condition (i.e. temperature or humidity) range.

In some embodiments, the difference between an outdoor environmental condition and an indoor environmental condition may be a direct determination, by subtraction of the indoor environmental condition from the outdoor environmental condition or vice-versa. In other embodiments, the difference may be an indirect determination, through use of another suitable equation that compares the outdoor environmental condition and indoor environmental condition. For example, in some embodiments, the outdoor environmental condition may be compared to the difference between the indoor environmental condition and a predetermined constant value. In some embodiments, the predetermined environmental condition range may be a range wherein the outdoor environmental condition is greater than the difference between the indoor environmental condition and the predetermined constant value. In other embodiments, the predetermined environmental condition range may be a range wherein the outdoor environmental condition is less than the difference between the indoor environmental condition and the predetermined constant value.

In some embodiments, the predetermined environmental condition range may be a closed range, i.e. a range between a lower threshold and an upper threshold. In other embodiments, the predetermined environmental condition range may be an open range, i.e. a range with only a lower threshold or only an upper threshold.

Further in exemplary embodiments, the predetermined environmental condition range that is utilized by the controller 85 may be selected (and selectable) from a plurality of predetermined environmental condition ranges. For example, the utilized range may be user-selectable or automatically selectable. Each range of the plurality of ranges may correspond with, for example, a particular location, climate, etc. where the air conditioner unit may be installed. In some embodiments, a user may utilize a user input 89 to select a range that corresponds with a particular location, climate, etc. where the air conditioner unit is installed. In other embodiments, a range may be automatically selected through, for example, interaction between the controller and a global positioning satellite ("GPS") unit or other suitable apparatus for determined a location, climate, etc. where the air conditioner unit is installed.

Air conditioner units 10 and bulkhead assemblies 100 in accordance with the present disclosure provide numerous advantages. For example, use of vent doors 120 and drive assemblies 130 advantageous reduce or eliminate the need to disassemble air conditioner unit 10 components to access the vent aperture 102 to manually cover and uncover the vent aperture 102. Further, automated control of vent doors 120 and drive assemblies 130 advantageously allows for vent doors 120 to be opened and closed as desired and as appropriate for vent apertures 102 to provide energy efficiency based on the appropriate outdoor and indoor environmental conditions.

The present disclosure is further direction to methods for operating air conditioner units 10. Such methods may similarly provide such advantages. In exemplary embodiments, controller 85 may be operable to perform various steps of a method in accordance with the present disclosure.

For example, in some embodiments, a method may include the step of measuring an indoor environmental condition and an outdoor environmental condition, as discussed above. It should be noted that such measurements may be taken contemporaneously, such as simultaneously.

A method may further include the step of determining whether a difference between the outdoor environmental condition and the indoor environmental condition is within a predetermined condition range (either directly or indirectly), as discussed above.

A method may further include moving vent door 120 of bulkhead assembly 100 into an open position wherein air flow through vent aperture 102 is permitted when the difference between the outdoor environmental condition and the indoor environmental condition is within a predetermined condition range, as discussed above. A method may further include moving vent door 120 of bulkhead assembly 100 into a closed position wherein air flow through vent aperture 102 is inhibited when the difference between the outdoor environmental condition and the indoor environmental condition is not within the predetermined condition range, as discussed above.

In some embodiments, the step of moving the vent door 120 into the open position includes actuating a drive assembly 130 to move the vent door 120 into the open position, and the step of moving the vent door 120 into the closed position includes actuating the drive assembly 130 to move the vent door 120 into the closed position. In other embodiments, the step of moving the vent door 120 into the open position includes actuating a drive assembly 130 to move the vent door 120 into the open position, and the step of moving the vent door 120 into the closed position includes de-actuating the drive assembly 130. In still other embodiments, the step of moving the vent door 120 into the open position includes de-actuating a drive assembly 130, and the step of moving the vent door 120 into the closed position includes actuating the drive assembly 130 to move the vent door 120 into the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

an outdoor heat exchanger;

an indoor heat exchanger;

a bulkhead disposed between the outdoor heat exchanger and the indoor heat exchanger along a transverse direction, the bulkhead comprising a first sidewall, a second sidewall spaced apart from the first sidewall along a lateral direction, and a rear wall extending laterally between the first sidewall and the second sidewall, the rear wall comprising an indoor facing surface and an opposing outdoor facing surface;

a vent aperture defined in the rear wall;

a vent door movable between an open position and a closed position, wherein in the open position the vent door permits air flow through the vent aperture and in the closed position the vent door, inhibits air flow through the vent aperture;

a drive assembly connected to the vent door and operable to selectively move the vent door between the open position and the closed position;

a first humidity sensor and a second humidity sensor, the first humidity sensor positioned in an indoor portion and configured to measure a contemporary indoor humidity within the indoor portion, the second humidity sensor positioned in an outdoor portion and configured to measure a contemporary outdoor humidity within the outdoor portion; and a controller in communication with the drive assembly, the controller operable to actuate the drive assembly and move the vent door between the open position and the closed position, wherein the controller is further operable to determine a difference between the contemporary outdoor humidity and the contemporary indoor humidity, move the vent door to the open position in response to a determination of the difference within a predetermined humidity range, and move the vent door to the closed position in response to a determination of the difference outside of the predetermined humidity range.

2. The air conditioner unit of claim 1, further comprising a first temperature sensor and a second temperature sensor, the first temperature sensor positioned in an indoor portion and configured to measure an indoor temperature, the second temperature sensor positioned in an outdoor portion and configured to measure an outdoor temperature.

3. The air conditioner unit of claim 2, wherein the controller is operable to move the vent door to the open position when a difference between the outdoor temperature and the indoor temperature is within a predetermined temperature range.

4. The air conditioner unit of claim 3, wherein the predetermined temperature range is user-selectable from a plurality of predetermined temperature ranges.

5. The air conditioner unit of claim 1, wherein the predetermined humidity range is user-selectable from a plurality of predetermined humidity ranges.

6. The air conditioner unit of claim 1, further comprising a filter positioned in alignment with the vent aperture.

7. The air conditioner unit of claim 1, wherein the bulkhead further comprises an air diverter extending laterally between the first sidewall and the second sidewall.

8. The air conditioner unit of claim 1, further comprising a blower fan and a heating unit each disposed at least partially within an interior of the bulkhead.

9. A bulkhead assembly for an air conditioner unit, the bulkhead assembly comprising:

a bulkhead, the bulkhead comprising a first sidewall, a second sidewall spaced apart from the first sidewall along a lateral direction, and a rear wall extending laterally between the first sidewall and the second sidewall, the rear wall comprising an indoor facing surface and an opposing outdoor facing surface;

a vent aperture defined in the rear wall;

a vent door movable between an open position and a closed position, wherein in the open position the vent door permits air flow through the vent aperture and in the closed position the vent door inhibits air flow through the vent aperture;

a drive assembly connected to the vent door and operable to selectively move the vent door between the open position and the closed position;

a first humidity sensor and a second humidity sensor spaced apart from the first humidity sensor by the bulkhead along a transverse direction, the first humidity sensor being configured to measure a first contemporary humidity, the second humidity sensor being configured to measure a second contemporary humidity; and a controller in communication with the drive assembly, the controller operable to determine a difference between the first contemporary humidity and the second contemporary humidity, move the vent door to the open position in response to a determination of the difference within a predetermined humidity range, and move the vent door to the closed position in response to a determination of the difference outside of the predetermined humidity range.

* * * * *